US008554089B2

(12) United States Patent
Shifley et al.

(10) Patent No.: US 8,554,089 B2
(45) Date of Patent: Oct. 8, 2013

(54) JOB ERROR CORRECTION IN A MULTICOLOR ELECTROPHOTOGRAPHIC PRINT ENGINE

(75) Inventors: James D. Shifley, Spencerport, NY (US); Alan J. Swire, Pittsford, NY (US); Thomas N. Tombs, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 540 days.

(21) Appl. No.: 12/618,086

(22) Filed: Nov. 13, 2009

(65) Prior Publication Data

US 2011/0117487 A1 May 19, 2011

(51) Int. Cl.
*G03G 15/00* (2006.01)
*G03G 15/01* (2006.01)

(52) U.S. Cl.
USPC ..... 399/9; 399/223; 399/226; 399/231; 399/299; 399/300; 399/401

(58) Field of Classification Search
USPC ..... 399/24, 309
See application file for complete search history.

(56) References Cited

U.S. PATENT DOCUMENTS

| | | | | |
|---|---|---|---|---|
| 4,958,828 | A | 9/1990 | Saito | |
| 5,087,945 | A | 2/1992 | Randall | |
| 6,332,066 | B1 | 12/2001 | Yanagawa | |
| 7,212,772 | B2 | 5/2007 | Kasiske et | |
| 7,324,240 | B2 | 1/2008 | Ng | |
| 7,468,820 | B2 | 12/2008 | Ng et al. | |
| 2002/0150409 | A1 | 10/2002 | Mitsuya et al. | |
| 2003/0129008 | A1 | 7/2003 | Seto | |
| 2005/0169677 | A1* | 8/2005 | Kaneko | 399/309 |
| 2006/0062608 | A1 | 3/2006 | Shimmura | |
| 2006/0120742 | A1 | 6/2006 | Kodama et al. | |
| 2007/0071460 | A1 | 3/2007 | Chizawa et al. | |
| 2007/0110461 | A1 | 5/2007 | Yoshida | |
| 2008/0050667 | A1 | 2/2008 | Lobo et al. | |
| 2008/0159786 | A1 | 7/2008 | Tombs et al. | |
| 2008/0219689 | A1 | 9/2008 | Lang et al. | |
| 2008/0240788 | A1* | 10/2008 | Mashtare et al. | 399/223 |
| 2009/0080911 | A1* | 3/2009 | Swantner et al. | 399/24 |
| 2009/0162113 | A1 | 6/2009 | Solcz et al. | |
| 2009/0324303 | A1* | 12/2009 | Crean et al. | 399/298 |
| 2010/0104303 | A1 | 4/2010 | Eun et al. | |

FOREIGN PATENT DOCUMENTS

| | | |
|---|---|---|
| EP | 0 895 134 | 2/1999 |
| EP | 1 548 523 A1 | 6/2005 |
| JP | 62/049377 | 3/1997 |
| JP | 2000-231279 | 8/2000 |
| JP | 2002-108021 | 4/2002 |
| JP | 2002-328486 | 11/2002 |
| JP | 2005-189719 | 7/2005 |
| JP | 2006-251695 | 9/2006 |
| JP | 2006-261819 | 9/2006 |
| JP | 2007-057703 | 3/2007 |
| JP | 2007-328061 | 12/2007 |
| JP | 2008-307731 | 12/2008 |
| JP | 2009-241293 | 10/2009 |

* cited by examiner

*Primary Examiner* — Walter L Lindsay, Jr.
*Assistant Examiner* — David Bolduc
(74) *Attorney, Agent, or Firm* — Ronald R. Schendler; David A. Novais

(57) ABSTRACT

A method and system for printing image documents using a variety of toners where some toners using a multi-development station having two or more development stations. These toners are co-printed prior to fixing, on the receiver by the multi-development station.

7 Claims, 18 Drawing Sheets

SKETCH A DUPLEX

SKETCH B MULTI-PASS SIMPLEX

JOB ERROR CORRECTION IN A MULTICOLOR ELECTROPHOTOGRAPHIC PRINT ENGINE

CROSS REFERENCE TO RELATED APPLICATIONS

This application relates to commonly assigned, copending U.S. application Ser. No. 12/618,108, filed Nov. 13, 2009, entitled: "ERROR CORRECTION IN A MULTICOLOR ELECTROPHOTOGRAPHIC PRINT ENGINE" hereby incorporated by reference.

FIELD OF INVENTION

This invention relates to an electrophotographic print engine. More specifically, this invention describes an apparatus capable of printing images using a multi development station.

BACKGROUND OF THE INVENTION

In order to produce a print using electrophotographic means, a primary imaging member, also referred to as a photoreceptor or a photoconductor, is first uniformly charged. An electrostatic latent image is then formed by image-wise exposing the charged using known methods such as an optical exposure system, an LED array, or a laser scanner. The primary imaging member is then brought into close proximity to a development station that contains electrically charged marking particles, often referred to as toner or dry ink so that the marking particles selectively adhere to the electrostatic latent image, thereby converting it into a visible image. The image is then transferred to an intermediate transfer member or directly to a receiver. The visible image on the receiver is then made permanent by fixing or fusing the image by, for example, subjecting the image-bearing receiver to a combination of heat and pressure. If desired, a gloss can be imparted onto the image by casting the image against a ferrotyping member, as is known in the art. The primary imaging member is then cleaned and made ready to produce a subsequent print.

To produce a color image, electrostatic latent images are formed corresponding to the subtractive primary colorant information, i.e. the cyan, magenta, yellow, and black colors of that comprise the color gamut of the image to be printed. These images, frequently referred to as separations, are transferred in register either to a receiver directly or to an intermediate member and then to the receiver. The image is then fixed, as described above.

Two distinct electrophotographic engine designs are used to produce color images using an electrophotographic module to produce an electrophotographic image. The first is an electrophotographic module that contains a primary imaging member, a primary charger, a means for creating an electrostatic latent image, a means for converting the electrostatic latent image into a visible image, and a means for transferring the visible image to either a transfer intermediate member or a receiver. The electrophotographic module can also contain appropriate cleaning devices or means to remove residual toner, etc. where necessary and appropriate. The printer also has other components not in the electrophotographic modules, such as a fuser, a receiver or paper feeding device, finishing devices such as staplers, stackers, collators, etc. In some printers there are also intermodule components such as a paper inverter.

In some instances components can be shared by more than one module. For example, a single primary imaging member in the form of a web can be used to create the electrostatic latent image corresponding to each of the separations. In this example, it is generally preferred to have different frames of the web primary imaging member used for each separation and then transfer the separations sequentially and in register to either an intermediate member or to a receiver. It is generally not desirable to use a cylindrical primary imaging member as a shared component in multiple electrophotographic modules as the size of such a cylinder would be prohibitively large and expensive.

Currently any electrophotographic engines with a plurality of development stations located in proximity to a single primary imaging member produce color prints by serially developing electrostatic latent images onto a primary imaging member. These engines require that a toned image be first transferred from the primary imaging member prior to the formation of a subsequent electrostatic latent image and the conversion of the electrostatic latent image into a visible image or the polarity of the charge of the toner in the two stations be opposite. In either application, converting the electrostatic latent image to a multiple of images with differing colors or toners requires that the sequential charging, formation of the electrostatic latent image, and conversion of the electrostatic latent image into a visible image. Thus, an image requiring two colors takes at least twice as long as that described in the present invention. For example an image requiring four colors would take four times as long to produce as one utilizing a single color.

Also present electrophotographic printers have other limitations. The color gamut obtainable is limited to that area in color space spanned by the subtractive primary colored toners. Thus, colors that contain vivid reds or greens might not be printable. Green, red, orange, blue, and violet toners are specialty toners that are used to enhance the available color gamut. Custom spot colors such as are commonly used in corporate logos are often outside the realm of the color gamut obtainable with standard subtractive primary colors. Magnetic recording inks, called MICR toners, are often used by banks to mark checks. These generally require a separate development station. The density versus the log of the exposure, often referred to as the D-log E curve, tends to become flat in both the low and high density regions of a print. These regions are referred to as the toe and shoulder, respectively, and are accompanied by a loss of information. It simply is not possible to differentially deposit varying amounts of toner in these regions to enhance the information. However, amounts of toner having a lower than normal colorant density or extinction coefficient can enhance the information content of these regions.

Another example of the limitation of the present technology is that there are many types of specialty toner required for one print. For example, normal-size clear toner particles, i.e. those having median volume weighted diameters in the range of approximately 5 μm to 8 μm, are often used to cover exposed portions of a receiver such as paper to enable an image on that receiver to be uniformly glossed and large clear toner, i.e. that having a median volume-weighted diameter of greater than approximately 20 μm, is often used to produce raised letter printing. In addition, toner particles are often used that contain security features that might be desired in the print, such as toner particles can contain so-called traceless components that would allow only certain detectors to detect the presence of the component. Combining all these toners, called specialty toners, into one latent images is not currently possible in one pass since in most electrophotographic print engines, the receiver is in sheet format. Transporting a sheet through a large number of electrophotographic modules is problematic and can lead to misregistration as well as artifacts such as fuser oil being transported back to a sheet from a transport web. As the length of the web increases to allow for additional electrophotographic modules, the probability of back transferring fuser oil from the transport web to the receiver increases.

In addition, these toner particles are often highly charged electrically. If there are too many toner particles present, such often occurs when multiple layers of toner are present, the electrostatic field used to transfer the toner is screened by the toner charge, thereby reducing the transfer field and impeding transfer. Thus, it is often difficult to transfer an arbitrarily large number of toner layers, in contrast to the lithographic printing of an arbitrarily large number of offset printed separations.

Finally, the space available for electrophotographic print engines is generally much more restricted than that available for offset presses.

The present invention allows all the printing of these specialty toners into one printer using one or more multi-development status.

SUMMARY OF THE INVENTION

This invention relates to an electrophotographic print engine having multi development stations that can print a variety of toners including certain specialty toners using a relatively compact engine. The specialty toners can be designed to enhance color gamut, apply specialty toners such as magnetic toners used by banks for tracking checks, a.k.a. MICR (toner used to print magnetic characters), clear toners use for purposes such as enhancing gloss, providing abrasion resistance, etc., toners containing security features such as so-called "traceless components", etc. The printing of at least some of the electrostatic latent images formed on a primary imaging member into visible images uses one or more multi-development stations to convert an electrostatic latent image on a primary imaging member or a frame of a primary imaging member into a visible image. The image is ultimately transferred to a receiver in register with other images that had been or will be transferred to the receiver. The station can be chosen either by the operator or by a process control or feedback mechanism that would call for that particular toner. The final print would thus be able to have multiple toners because the multi development station would contain a plurality of development stations would be able to deposit multiple toners onto the eventually formed print. This invention allows an electrophotographic print engine to print using many specialty inks without unduly increasing its size.

As a result of these constraints, it is readily apparent that an arbitrarily large number of electrophotographic modules cannot be incorporated into a typical electrophotographic engine, despite the need to enable printing using specialty toners to augment the capabilities of the substractive primaries. It is the goal of this invention to describe a method and apparatus capable of meeting this requirement.

DETAILED DESCRIPTION OF THE INVENTION

Figure 1A:
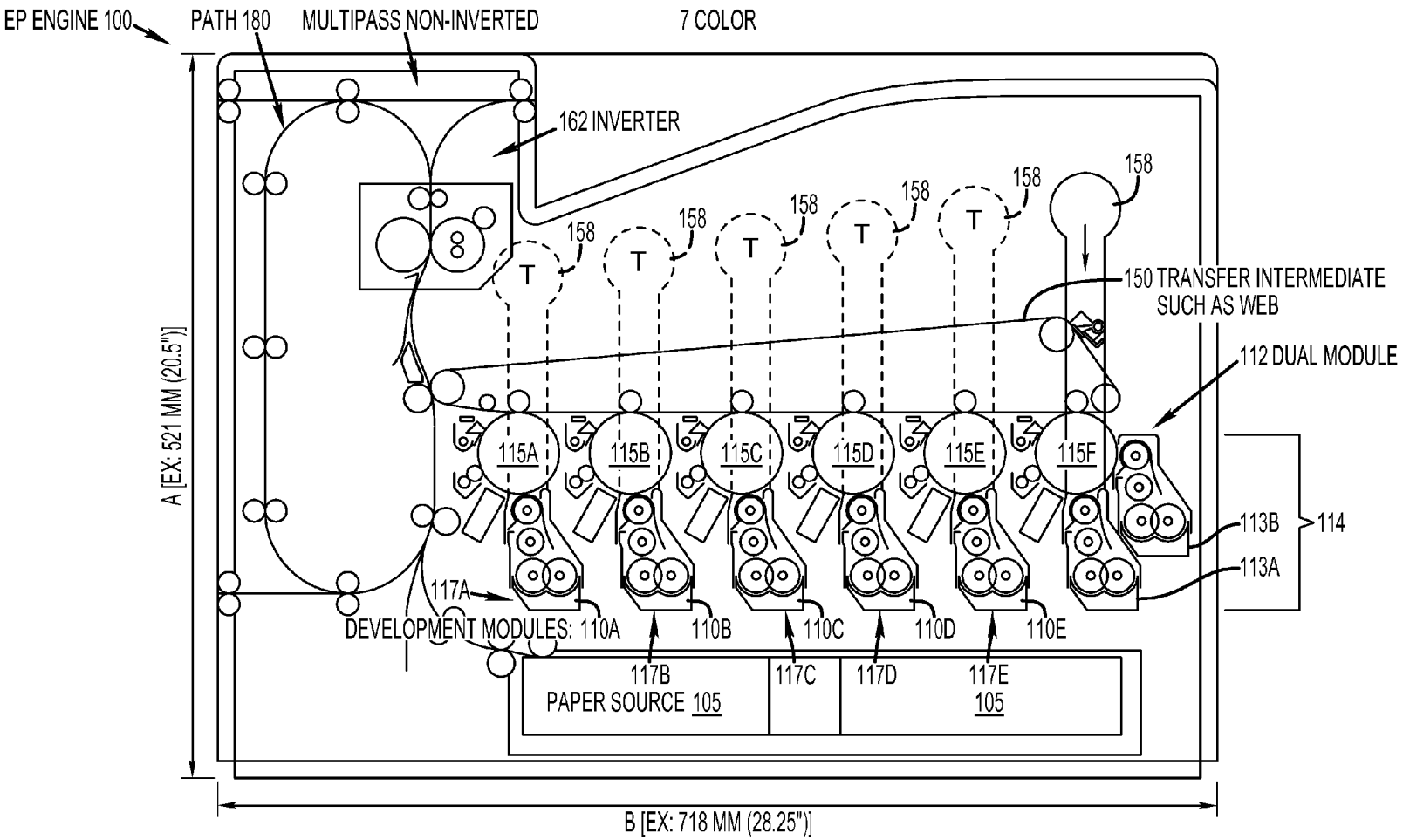
FIGS. 1A and 1B depict two embodiments of the present invention
Figure 1B:
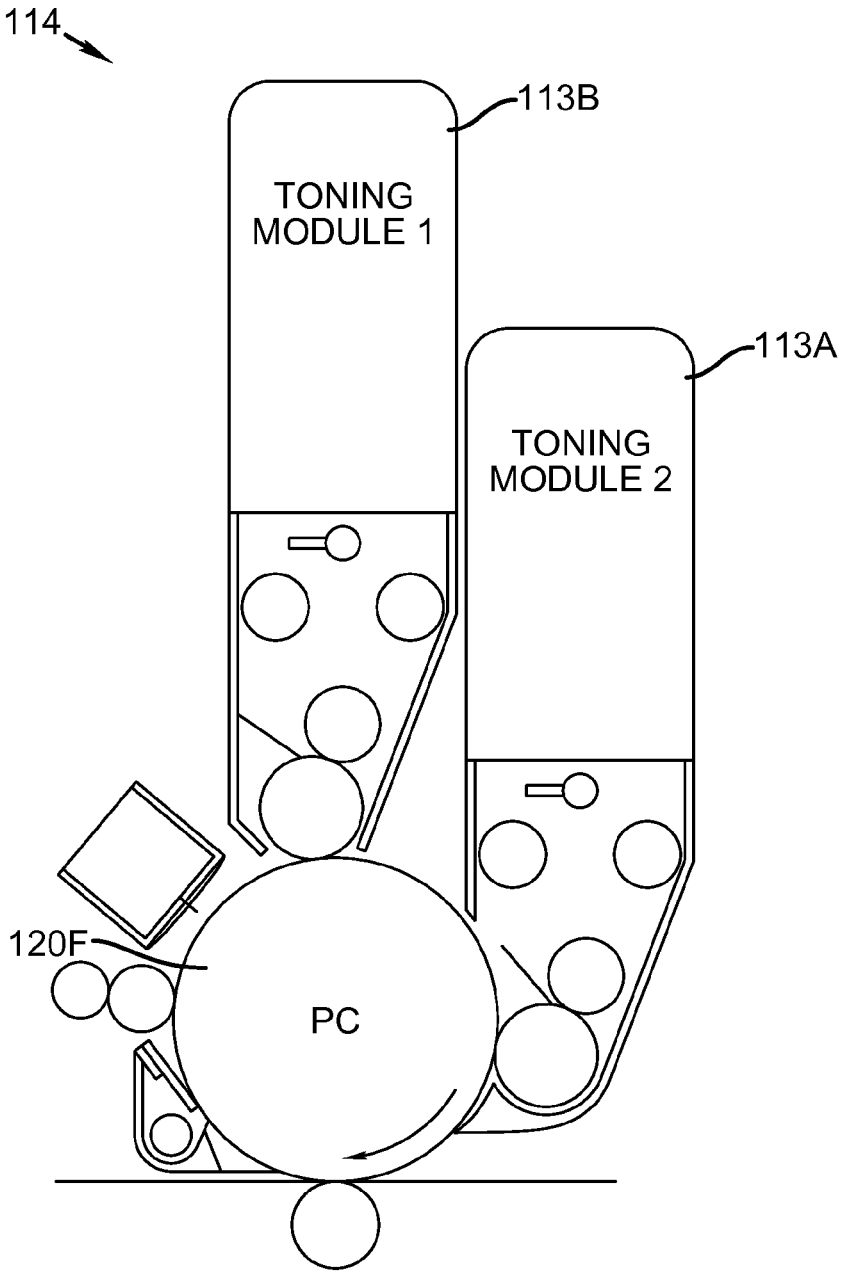
Figure 2:
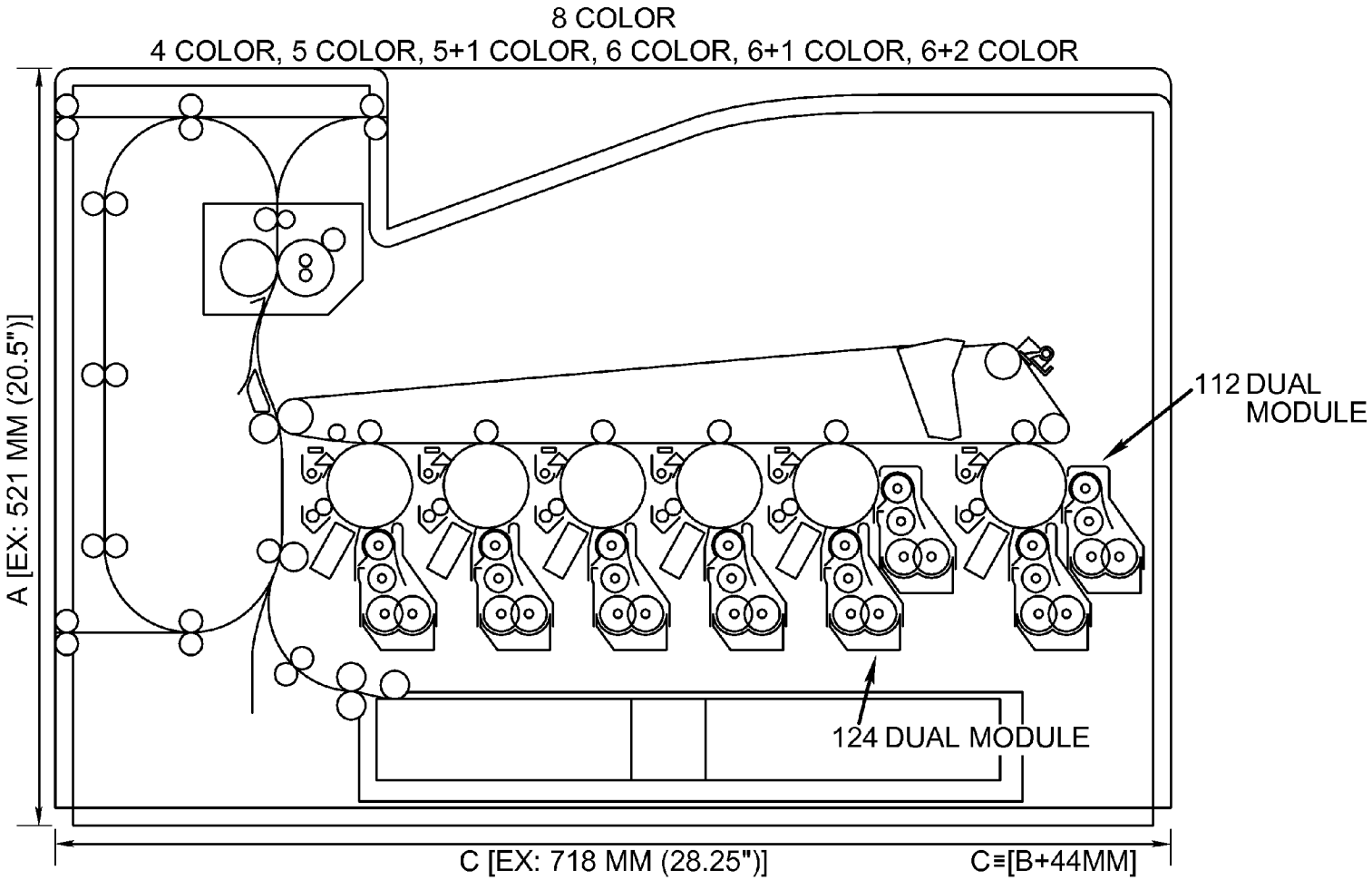
FIG. 2 depicts another embodiment of the present invention.

FIG. 1 shows an electrophotographic (EP) engine (100) or printer, often referred to as a tandem print engine including EP modules (110A, 110B, 110C, 110D, and 110E), wherein each contains a single primary imaging member (115A, 115B, 115C, 115D, and 115E) and a single development station (117A, 117B, 117C, 117D, and 117E) to print on receiver 111. In addition, a sixth EP module (112) is shown containing development stations 113A and 113B which form a multi-development station 114. The EP printer is shown having dimensions of A×B which are around in one example, 52×718 mm or less. FIG. 2 shows a slightly larger printer where B is expanded to accommodate the second multi-development engine. This new engine is designed so that the multi-development stations are able to be incorporated into a smaller engine using larger imaging members than are normally used. Development stations 110A though 110E would typically contain toner (T) that is typically used in most color prints. For example, toner having typical optical densities such that a monolayer coverage (i.e. sufficient toner such that a microscopic examination would reveal a layer of toner covering between 60% and 100% of a primary imaging member would have a transmission density in the primarily absorbed light color, as measured using a device such as an X-Rite Densitometer with Status A filters of between 0.6 and 1.0) of the subtractive primary colors cyan, magenta, yellow, and black would typically be contained in four of these development stations. The multi development station can be used to print for a toner that is commonly used for many applications, selectively determined by a control element. An individual operating or owning (hereafter referred to as the operator) the EP engine could control the control element and this effectively determines which specialty toner would print.

For example, a full-color image can be made using toner or ink containing typical cyan, magenta, yellow, and black subtractive primary colorants such as pigment particles or dyes. Each toner is contained in a development station that develops an electrostatic latent image and is in proximity to a cylindrical primary imaging member or a frame of a primary imaging member in the form of a continuous web. Additional toners corresponding to specialty toners or inks are contained in one of a plurality of development stations, any one of which can be brought into proximity with a primary imaging member bearing an electrostatic latent image and convert that electrostatic latent image into a visible image. For example, an electrophotographic engine can contain five print modules. Four of the modules would each contain a single development station containing toners of one of the four subtractive primary colors. The fifth module is shown with a multi-development station, having a plurality of development stations, each containing a distinct specialty ink that can convert an electrostatic latent image into a visible image with only that specific specialty ink.

For example, if clear toner is commonly used by a particular EP engine, the fifth station could contain clear toner. Alternatively, other toners that would be commonly used throughout a variety of jobs can be contained in the fifth station. Development stations suitable for use in this invention include dry development stations containing two component developers such as those containing both toner particles and magnetic carrier particles, or single component development stations. The development stations used for two component development can have either a rotating magnetic core, a rotating shell around a fixed magnetic core, or a rotating magnetic core and a rotating magnetic shell. Single component development stations suitable for use in this invention are known in the literature. It is preferred that the toners used in practicing this invention are a component of dry developers.

The sixth EP module 112 with the multi-development station 114 is capable of selectively printing one or more toners such as K-K (black and black), two colors including black and/or a color and a specialty toner. Specialty toners include transparent, raised print, MICR magnetic characters, specialty colors and metallic toners as well as other specialty toners that are not the basic color toners. The multi-development station 114 can have two (as shown in FIG. 1*a*) or more development stations in communication to one photo conductor so that the two or more development stations deposit toner onto an electrostatic latent image on primary imaging member 115F. In another embodiment, as shown in FIG. 1*b* the multi-development station is a monocomponent module which can be integrated with dual component or monocomponent development stations giving even more stability. Here one or both stations can deposit toner onto the primary imaging member during a single pass of a receiver through the EP engine. The larger photo conductor enables the location of the multi development station 114 shown.

In the example shown in FIG. 1*a*, after each development station develops the electrostatic latent image on the primary imaging member (PIM), thereby converting the electrostatic latent image a visible image, each image is transferred, in register, to an intermediate transfer member (ITM) 150. The ITM can be in the form of a continuous web as shown or can take other forms such as a drum or sheet. It is preferable to use a compliant intermediate transfer member, such as described in the literature, but noncompliant ITMs can also be used.

Figure 3:
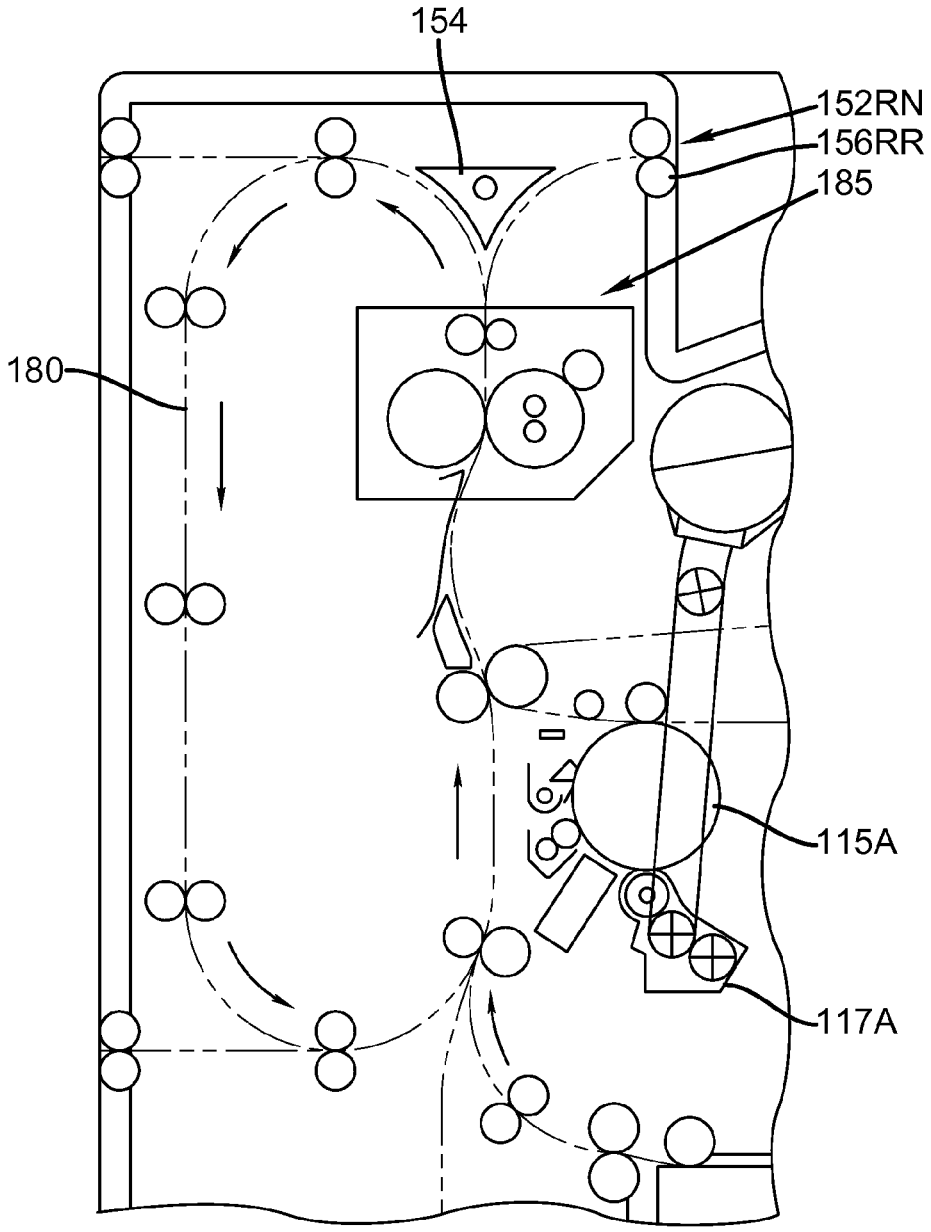
FIG. 3 shows a diverter that is positioned so as to allow a receiver sheet to be reprinted in the simplex mode according to the present invention.
Figure 4:
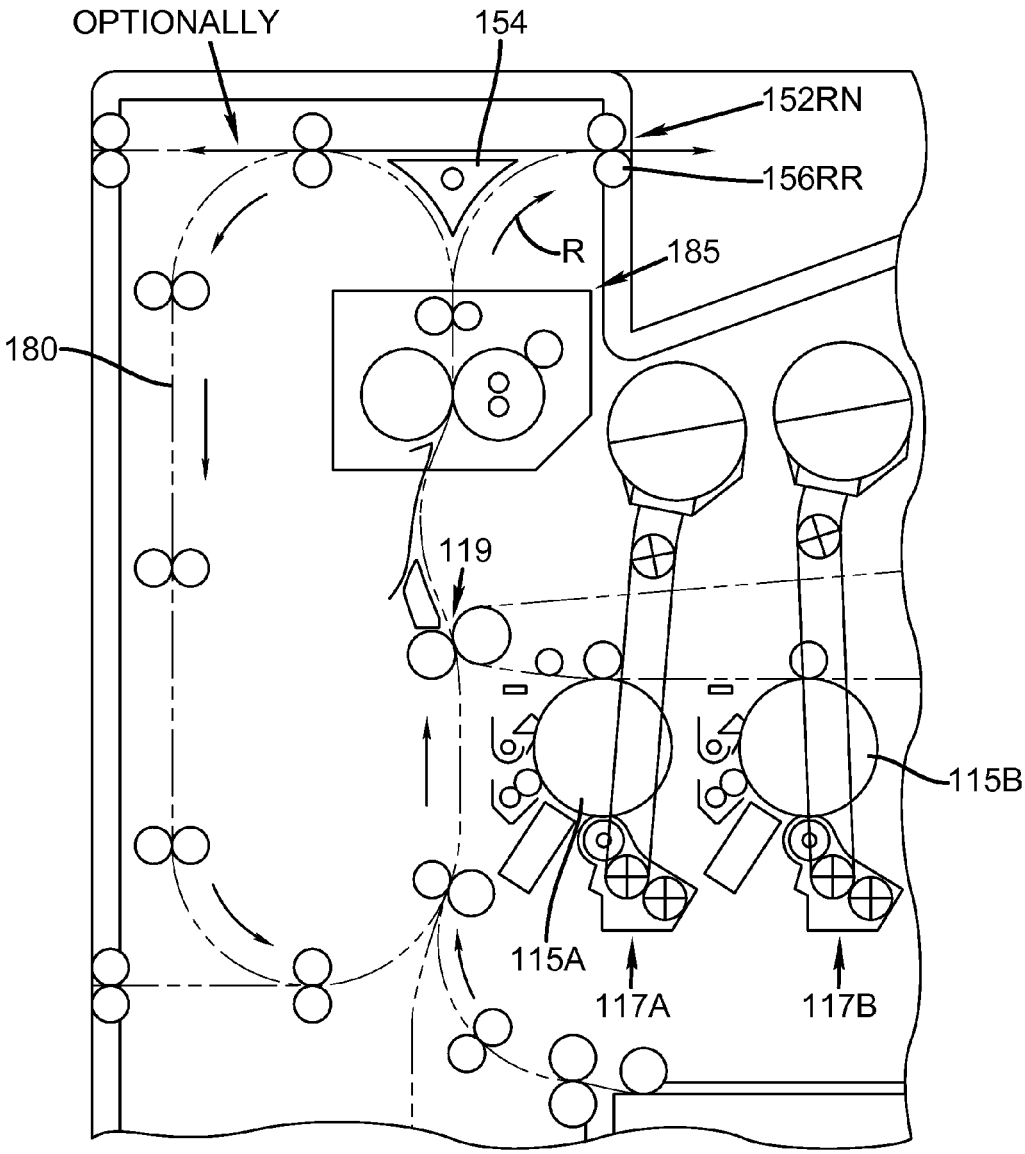
FIG. 4 shows a diverter that is positioned so as to allow a receiver sheet to be reprinted in the duplex mode according to the present invention.

The receiver sheets 111 are held in the printer at the paper tray 105 and, in the example shown, enter the paper path 180 so as to travel initially in a clockwise direction. The paper could also be manually input. The printed image is transferred from the ITM to the receiver and the image bearing receiver then passes through a fuser 170 where the image is permanently fixed to the receiver. The image then enters a region where the receiver either enters an inverter 185, continuing to travel clockwise, stops, and then travels counterclockwise back onto the paper path 180. This inverts the image, thereby allowing the image to be duplexed. Prior to the inverter is a diverter 152 that diverts the receiver sheet from the inverter and sends it back along the paper path in a counterclockwise direction. This allows multiple passes of the receiver on the simplex side, as might be desired if multiple specialty toners contained in the multi development station 114, shown here as development stations 113A and 113B, are to be used in a printer or if special effects such as raised letter printing using large clear toner is to be used. It should be noted that, if desired, the fuser 170 can be disabled so as to allow a simplex image to pass through the fuser without fusing, if desired. This might be the case if an expanded color balance in simple printing is desired and a first fusing step might compromise color blending during the second pass through the EP engine. Operation of the diverter to enable a repeat of simplex and duplex printing is shown in FIGS. 3 and 4, respectively. Alternatively, a fusing system that merely tacks, rather than fully fuses an imam and is known in the literature can be used if desired such as when multiple simplex images are to be produced. The image can also be sent through a subsystem that imparts a high gloss to the image, as is known in the literature and is described in co-owned U.S. Pat. Nos. 7,212,772; 7,324,240 and 7,468,820 as well as U.S. Publications 2008/159786 and 2008/0050667, which are hereby incorporated by reference. This is especially important as one embodiment of the use of clear toner as a specialty toner in this invention.

The diverter 154 is a movable section of the paper path that can be activated to either of the two positions. The diverter can be activated by known means such as a solenoid, motor, compressed air, or vacuum. In FIG. 4 it is shown that, in the duplex position, the receiver sheets are directed toward the right underside (as shown by arrow R) and into the reversing nip 152 (RN). Once the trail edge of the sheet clears the diverter 154, the reversing rollers (156 (RR) reverse direction and move the sheet towards the return path. The top of the diverter profile is shaped to enable the trail edge of the sheet (which has now has become the lead edge) to be picked up and guided over the top of the diverter and towards the return path (180) for imaging the second side of the sheet 111. When the diverter 154 is in the multi-pass simplex position the lead edge is guided towards the left underside of the diverter into the return path and back to transfer nip 2 119 for transfer of another image or images to the same side of the sheet.

It should be noted that in the embodiment where development stations 113A and 113B are not both used during a single pass of a receiver sheet through the EP engine, the development stations can be used alternatively by diverting receiver from the inverter and printing a second simplex image on the same receiver sheet when the receiver passes through the multi-development station 114 a second time.

It should be noted that, although the dual module 112 is shown in the position of being at the extreme right and, accordingly, the last station to transfer an image onto the ITM 150, it can be placed between, before, subsequent to any other station, depending on the intended use. Moreover, between any two stations, auxiliary components such as conditioning chargers, cleaners, or fusers or image tackers can also be installed. It should also be noted that, although the present example incorporates an ITM web, alternative configurations such as separate ITM drums in each EP module or direct transfer to the receiver is also included in the present invention. It should also be noted that, for this invention to work, the toners contained in each development station must have the same polarity of the charge, irrespective of the type of development station used. It is preferred that the toners be negatively charged. The development stations need not all be similar. For example, stations 110A, 110B, and 110C may employ a rotating magnetic core whereas development station 110D may have a fixed magnetic core and a rotating shell and development stations 113A and 113B can use a single component developer. In addition, the primary imaging members need not be identical. For example, the primary imaging members can differ in diameter from one module to another, thereby allowing cylindrical primary imaging members with smaller diameters, for example, of 30 mm to be used in those modules containing a single development station and primary imaging members of larger diameters such as 60 mm to be used in the modules containing two or more development stations. Some modules can also contain primary imaging members in the form of a web, whereas others may contain cylindrical primary imaging members.

In the present example, the EP engine is configured so that the PIMs rotate in a counterclockwise direction. In this scenario, it is preferred that the position of the development station 113A be between 5:00 and 7:00, preferably at 6:00 and development station 113B be located between 2:00 and 4:00 with respect to the cylindrical primary imaging member employed in this example.

So-called single component development stations, i.e. those that do not use or contain magnetic carrier particles to charge or transport the toner particles and are well known in the art, can also be used in the practice of the present invention. However, single component development stations do not function well if located in the 6:00 position with respect to the primary imaging member. In practicing this invention, a module with two or more development stations can use one or more single component development stations in that module. If the electrophotographic print module contains a cylindrical primary imaging member and two development stations of which one is a monocomponent development station and one is a two-component development station; the two-component development station should be located between the 5:00 and 7:00 position and the monocomponent development station located between the 8:00 and 12:00 position with respect to the primary imaging member and in sufficiently close proximity to the primary imaging member so as to allow an electrostatic latent image on the primary imaging member to be converted into a visible image for a primary imaging member running in a counterclockwise direction. If the electrophotographic print module contains a cylindrical primary imaging member and two monocomponent development stations of; each development station should be located between the 8:00 and 12:00 position with respect to the primary imaging member and in sufficiently close proximity to the primary imaging member so as to allow an electrostatic latent image on the primary imaging member to be converted into a visible image for a primary imaging member running in a counterclockwise direction.

If the electrophotographic print module contains a cylindrical primary imaging member and two development stations of which one is a monocomponent development station and one is a two-component development station; the two-component development station should be located between the 5:00 and 7:00 position and the monocomponent development station located between the 4:00 and 12:00 position with respect to the primary imaging member and in sufficiently close proximity to the primary imaging member so as to allow an electrostatic latent image on the primary imaging member to be converted into a visible image for a primary imaging member running in a clockwise direction. If the electrophotographic print module contains a cylindrical primary imaging member and two monocomponent development stations of each development station should be located between the 4:00 and 12:00 position with respect to the primary imaging member and in sufficiently close proximity to the primary imaging member so as to allow an electrostatic latent image on the primary imaging member to be converted into a visible image for a primary imaging member running in a clockwise direction.

In another embodiment of the present invention, multiple EP modules containing a plurality of development stations are contained in the EP engine. An example showing two modules containing two development stations is shown in FIG. 2. Additional such modules incorporating a plurality of development stations can also be included up to and including all EP modules within the EP engine containing a plurality of development stations. It is preferred that the plurality consist of two development stations, as additional stations can present difficulties in allocating sufficient space within the restrictions of the EP engine. It should also be noted that the modules containing multiple development stations 114 need not be located adjacent to one another and can, in fact, be located anywhere along the development path. Thus, module 124 containing a multi-development station 114 having a plurality of development stations and module 110B, for example, can be interchanged as long as the control unit 210 (see FIG. 7) for the print engine is programmed to know which modules are single development station modules and which have a plurality of modules. In addition, sufficient space must be allocated for any multiple module station. Finally, the control unit must be programmed to specify which development station is to be used for a given application when using EP modules with multiple development stations.

Specialty toners 158 as shown in FIG. 1A, consists of the group of toners that extend the printing capabilities of an electrophotographic engine beyond that obtainable with the conventional cyan, magenta, yellow, and black subtractive primary colored toners used to convert the electrostatic latent images of the cyan, magenta, yellow, and black separations into visible images. Accordingly, color gamut enhancing toners such as green, red, blue, and violet colored toners are specialty toners. Dry inks can be designed to enhance color gamut, apply specialty inks such as magnetic inks used by banks for tracking checks, a.k.a. MICR, clear inks use for purposes such as enhancing gloss, providing abrasion resistance, etc., inks containing security features such as so-called "traceless components", etc. These are also specialty toners. Specialty toners also include normal-size clear toner particles, i.e. those having median volume weighted diameters in the range of approximately 5 μm to 8 μm, that are often used to cover exposed portions of a receiver such as paper to enable an image on that receiver to be uniformly glossed. Alternatively, large clear toner, i.e. that having a median volume-weighted diameter of greater than approximately 20 μm, is often used to allow raised letter printing and are considered specialty toners. Low density toners, i.e. toners having the color of one of the subtractive primary colors of cyan, magenta, yellow, or black so that a monolayer of that toner, defined as a layer of toner such that a microscopic examination would reveal a layer of toner covering between 60% and 100% of a primary imaging member would have a transmission density in the primarily absorbed light color, as measured using a device such as an X-Rite Densitometer with Status A filters of between 0.1 and 0.4 are also considered specialty toners.

Print jobs having job specifications, such as those supplied by a customer, can be inputted into the presently described electrophotographic apparatus in many known manners including submitting electronic files directly, scanning original prints, etc. The operator can directly specify which specialty toners, if any, are to be used for a given print job. Alternatively, the control system for the electrophotographic engine can determine what specialty toners are required for a job. For example, the control system can determine from the electronic file that low density cyan and green are needed to accurately portray a scene depicting the coronation of a king on a clear day. Alternatively, the operator can manually input into the machine that these colors are to be included in printing the job. The separations are rendered using known techniques and appropriate color corrections, such as undercolor removal, as are known in the art, are implemented.

If, for example, the electrophotographic engine contains four EP modules, of which two contain a single development station and two contain two development stations each, the cyan. magenta, yellow, and black separations can be printed and transferred to the receiver. The image may or may not be fused, depending on the specified operating conditions. The receiver is then diverted so as to not enter the inverter 162, but rather be allowed to pass through the print engine a second time. This is sometimes referred to as a multipass print. The returning receiver is of toner fused but could be fused to allow more options. The low density cyan and the green separations are then printed in the respective EP modules and transferred to the receiver on the same side of the receiver that received the first set of separations. The image is fused and diverted to the inverter so that duplexing imaging can be performed, if desired. This mode is obviously just one of the variations that can be used in practicing this invention. As few as a single module or as many as all the modules can contain multiple development stations and be used in this manner to expand printing capabilities of the EP engine.

It is anticipated that job specification errors can occur when printing using a multi development station. In order to correct any resulting errors, including errors in the execution of a job that requires the use of a multi-development station in an EP module, an error correcting method is required. In one embodiment the error correction method is used when a job requires red and green toners both be used on the print and these two toners are contained in the multi-development stations of a single EP module. The EP engine cannot print with both toners at the same time so the job must resolve the error using the error correction method and the correction module in the controller. The error correction module in this embodiment has two distinct methods of resolving the error that can be used depending on the situation. The green can be printed first and the receiver ran through again for the red toner or vice versa. The correcting module automatically chooses based on the image and using the multi-development station.

For example, if the job specification explicitly specifies one or more colorants that need to be employed in the process of preparing the job for printing, also called rendering, an evaluation of the job data can be made prior to preparing to determine which colorants would be the best suited to fulfill the job and in what order. Preparing the job includes processing image data by providing raterized color separations (RIP Data), subjecting the rip data to processing and possibly comparing it to the data source. This could be done by evaluating spot colors that are specifically called out in the job (MICR, NexPress dimensional clear, e.g.) or through analysis which determines the gamut of colors that would provide the most faithful reproduction of the job. In this case, the evaluation might lead to the conclusion that processing the colors in addition to cyan, magenta, yellow, and black (CMYK) would result in a more accurate rendition than (CMYK) alone. For example, in jobs that contain photographs of people, additional colorants such as a light magenta and light cyan that are specially formulated for photographic reproduction may be determined to be the best colorants for the most faithful color rendition of the job as compared to its original intent.

An additional processing alternative would be either through specification or job data analysis determine the lay down order of the colorants which would lead to the either the most faithful color rendition or a unique desired effect. For example, a white colorant might want to be flood coated or laid down over the entire surface prior to any other colorants to achieve a certain effect.

Prior to the initiation of the process, an evaluation is made of the available colorants in the EP engine, and is compared to the colorants that have been selected by any of the methods previously described.

In the method where a mismatch between the job specification and the colorant that are available result in operator intervention, error messages are displayed and the sequence of instructions to the operator to correct the error are provided. These may include manual modification of the job specification to eliminate unavailable colorants, or the installation and/or the removal of specific colorant stations from the EP engine to satisfy the mismatch condition. Once the error condition has been satisfied, the job will be processed with planar data for all the colorants required for the job.

In the method where there is an automated method of the EP Engine self-correction, the job is processed and/or as above and the planar data associated with colorants is supplied to the EP Engine when required. For example, in a job that is determined to require seven colorants, in a Tandem engine that can have only six colorants available for each pass through the EP Process, the first six planes of data are sent to the EP engine (i.e. cyan, magenta, yellow, black, light cyan, light magenta). On the next pass through the EP engine, the next plane of data would be sent to the EP engine such as the need for clear toner for glossing applications.

The term planar data refers to color data that allows for the pixel value organization that involves the separation of image data into two or more planes, as is known and commonly used in the field of color science.

The EP printer can print by moving the receiver 111 past the print modules one time or multiple times. An operator can also add instructions via a control unit including touching apps on a screen in communication with the controller. Alternatively the controller can refer to markings or other indicators on parts of the printer, such as the development station. If the receiver passes the modules one time it is commonly referred to as a single pass. If it goes through multiple times it is a multi pass print job. One embodiment of a multipass print job also incorporates a control unit capable of self correcting a print or job error. This method includes first printing by one or more of at least two electrophotographic modules by first charging a primary imaging member, creating an electrostatic latent image by image-wise exposing the one or more primary imaging members; converting the electrostatic latent image into a visible image by bringing the electrostatic latent image into close proximity to a multi-development station in the one or more electrophotographic modules; and transferring the visible image to an intermediate transfer member. For a multi pass print then another pass is made by the receiver after the receiver passes through the diverter and/or inverter, to create at least one additional electrostatic latent image by at least one of the electrophotographic modules. This image can be made by a multi-development station or a single development station. Then the electrostatic latent image is converted into a visible image by bringing the electrostatic latent image into close proximity to this development station in the electrophotographic module as the receiver passes through a second time. The toned image is transferred to the transfer intermediate member bearing the previously toned image on the same side and/or the opposite side of the receiver as the previously toned images and the toned image is transferred from the intermediate transfer member to the receiver. Finally the toned image is made permanent by fusing.

One of the challenges encountered when transferring a second image to the sheet, especially for multi-pass simplex, is accurately aligning the image to the sheet. Any registration errors can adversely affect this alignment include: various in-track, skew, and cross-track positioning errors occurring as the sheet moves thru the paper path from transfer nip 2 119 where the first image was transferred back to that transfer nip 2 119 for the second image transfer. Another error is due to shrinkage of the sheet caused by removing moisture as the sheet passes thru the fuser. It is necessary to control these errors using the control unit. For example it is possible to apply countermeasures for correcting the in-track, skew, and cross-track positioning errors and sheet shrinkage for a given sheet or substrate type by adjusting various components and their setups. The control used would access information such as in a look up table (LUT) to do this.

Figure 7:
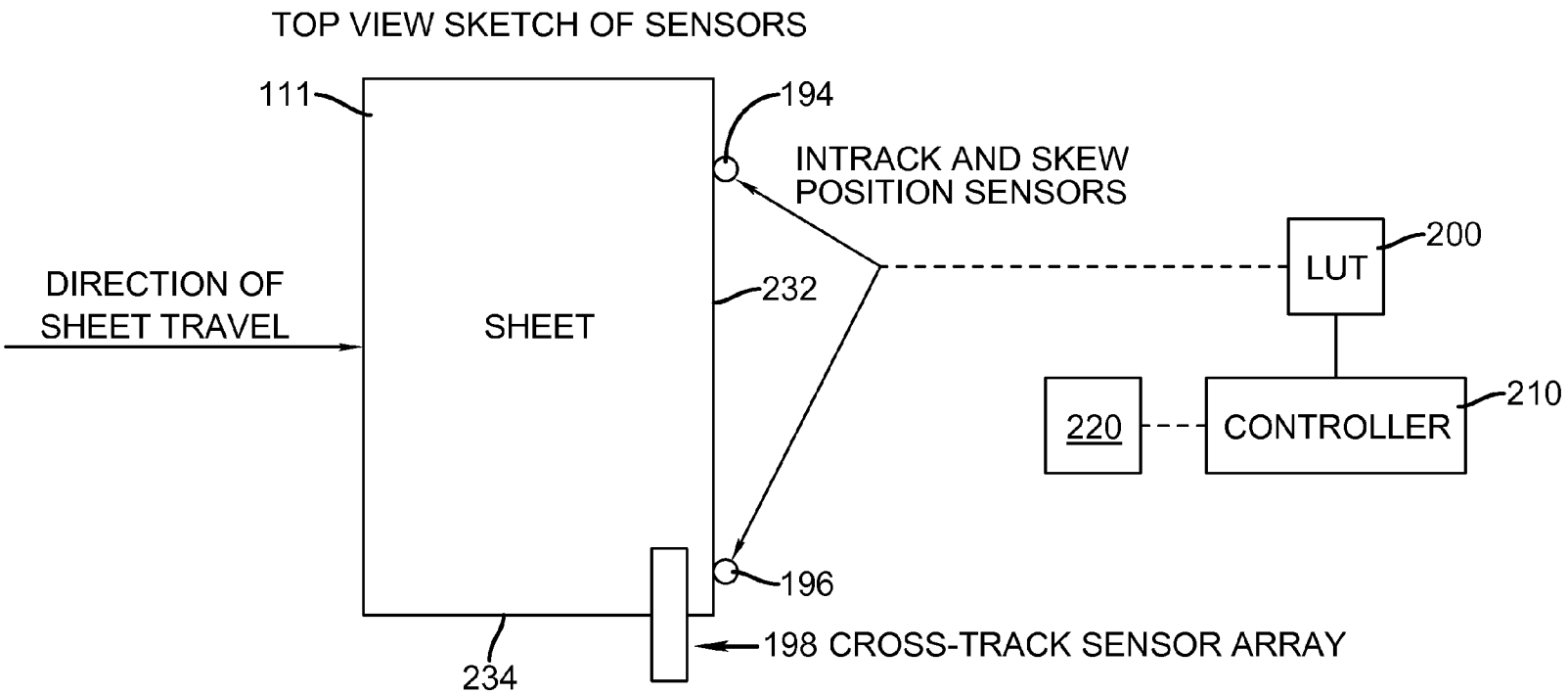
FIG. 7 shows a method of using skew and position sensors for tracking the position of a receiver sheet in a multipass simplex operation of the present invention.
Figure 8A:
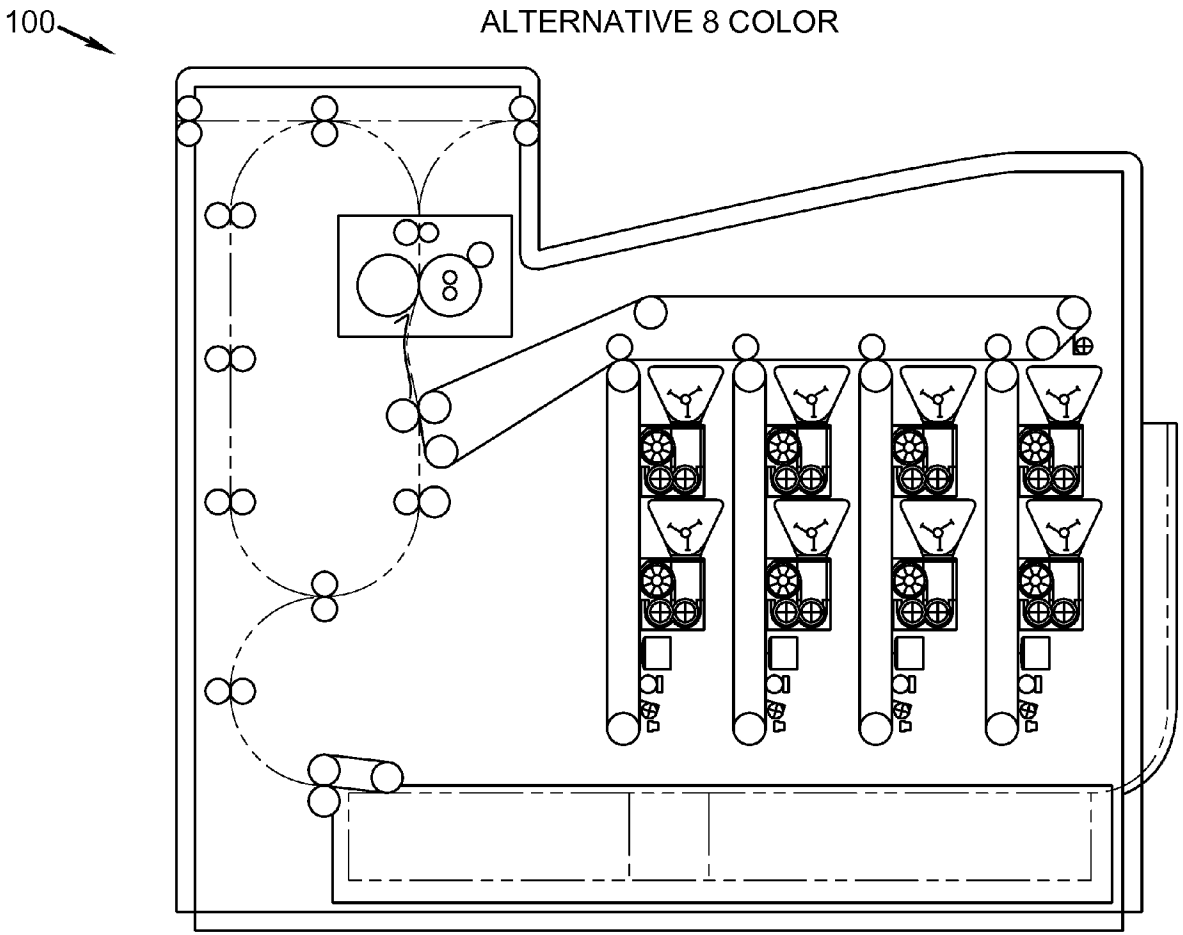
FIG. 8A-I shows other embodiments of the present invention.
Figure 8B:
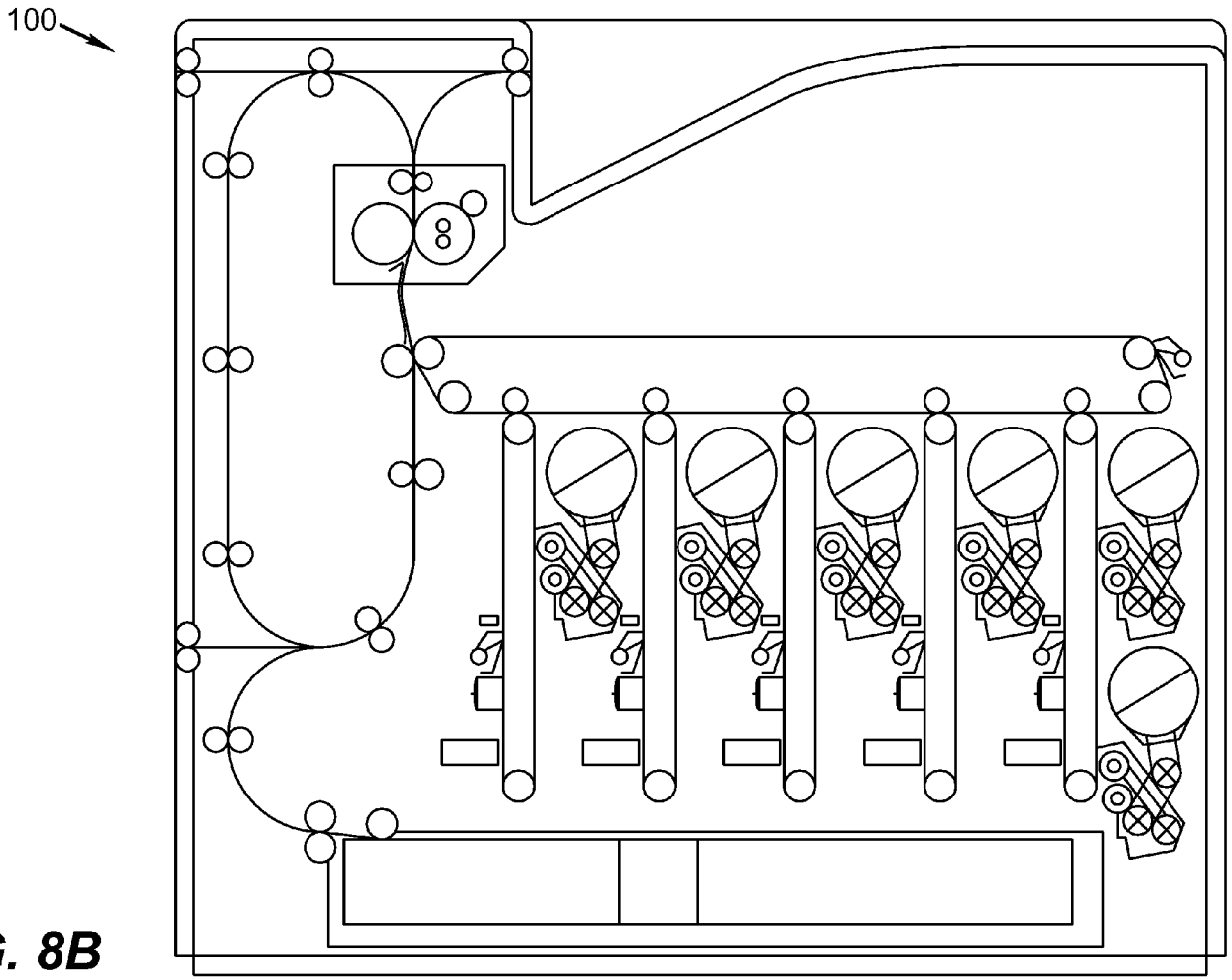
Figure 8C:
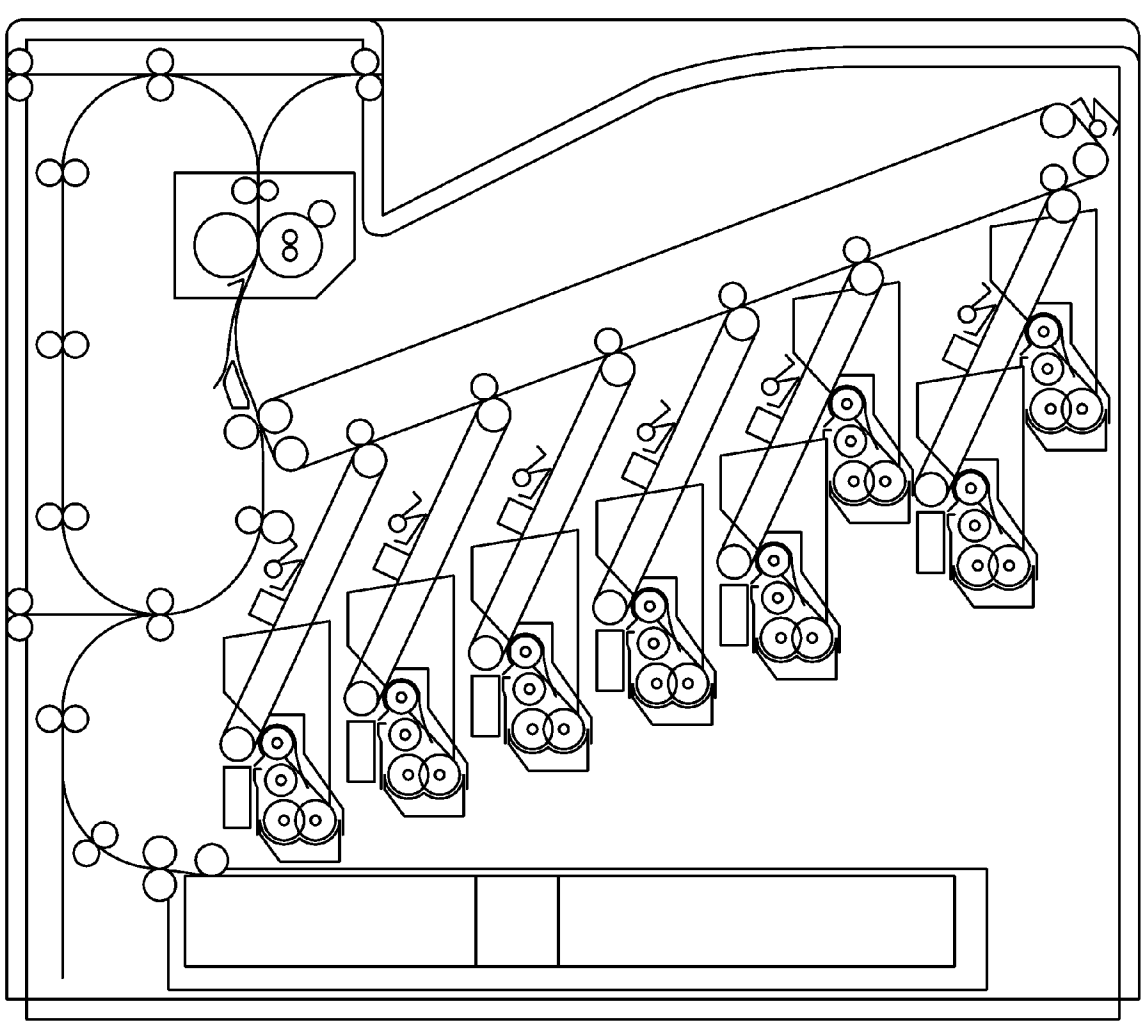
Figure 8D:
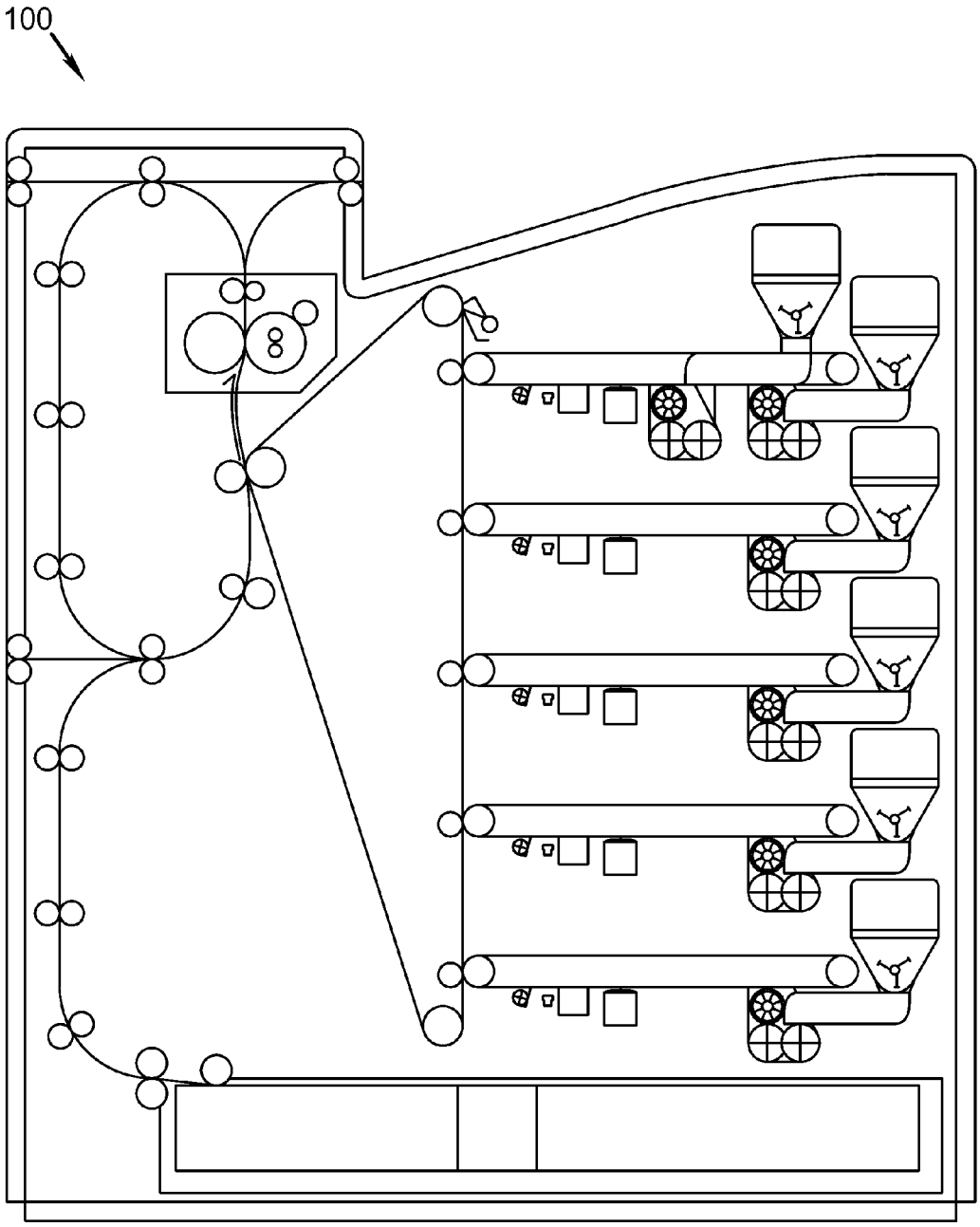
Figure 8E:
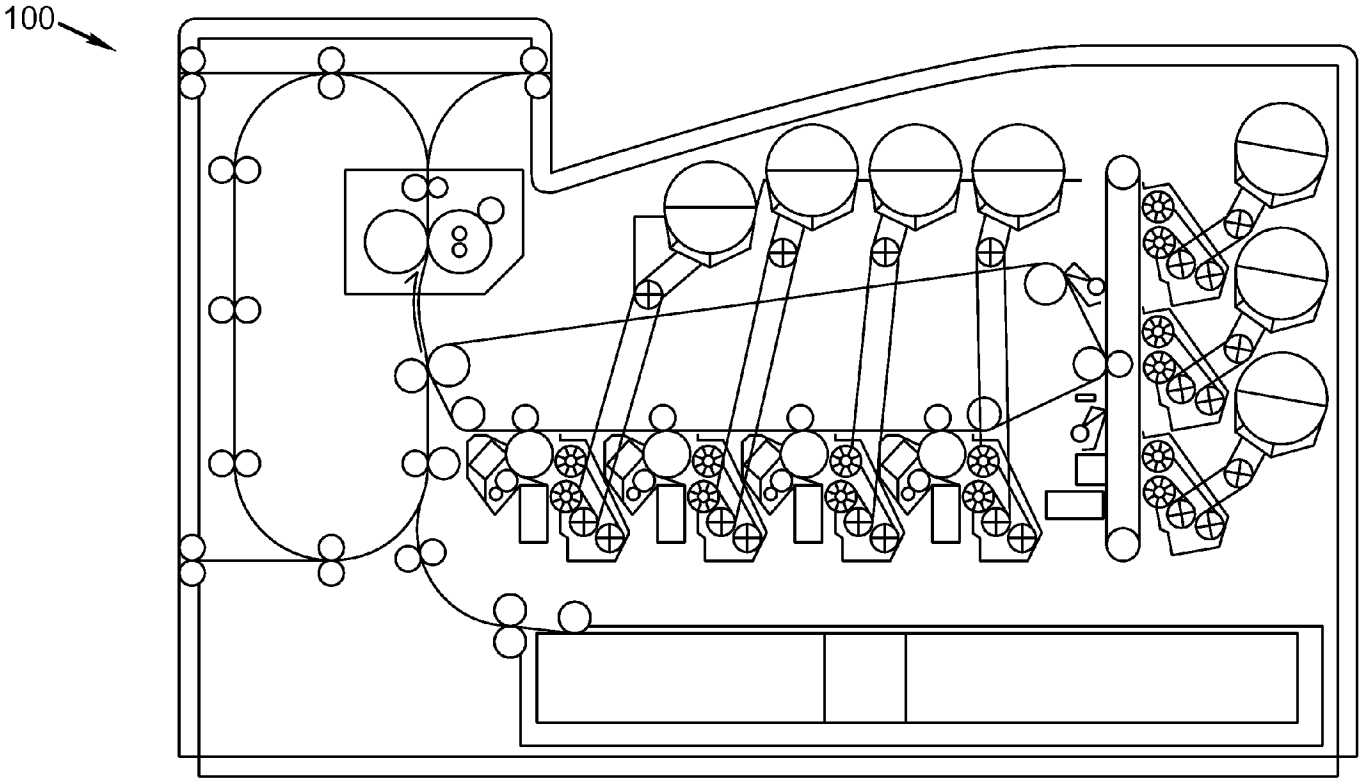
Figure 8F:
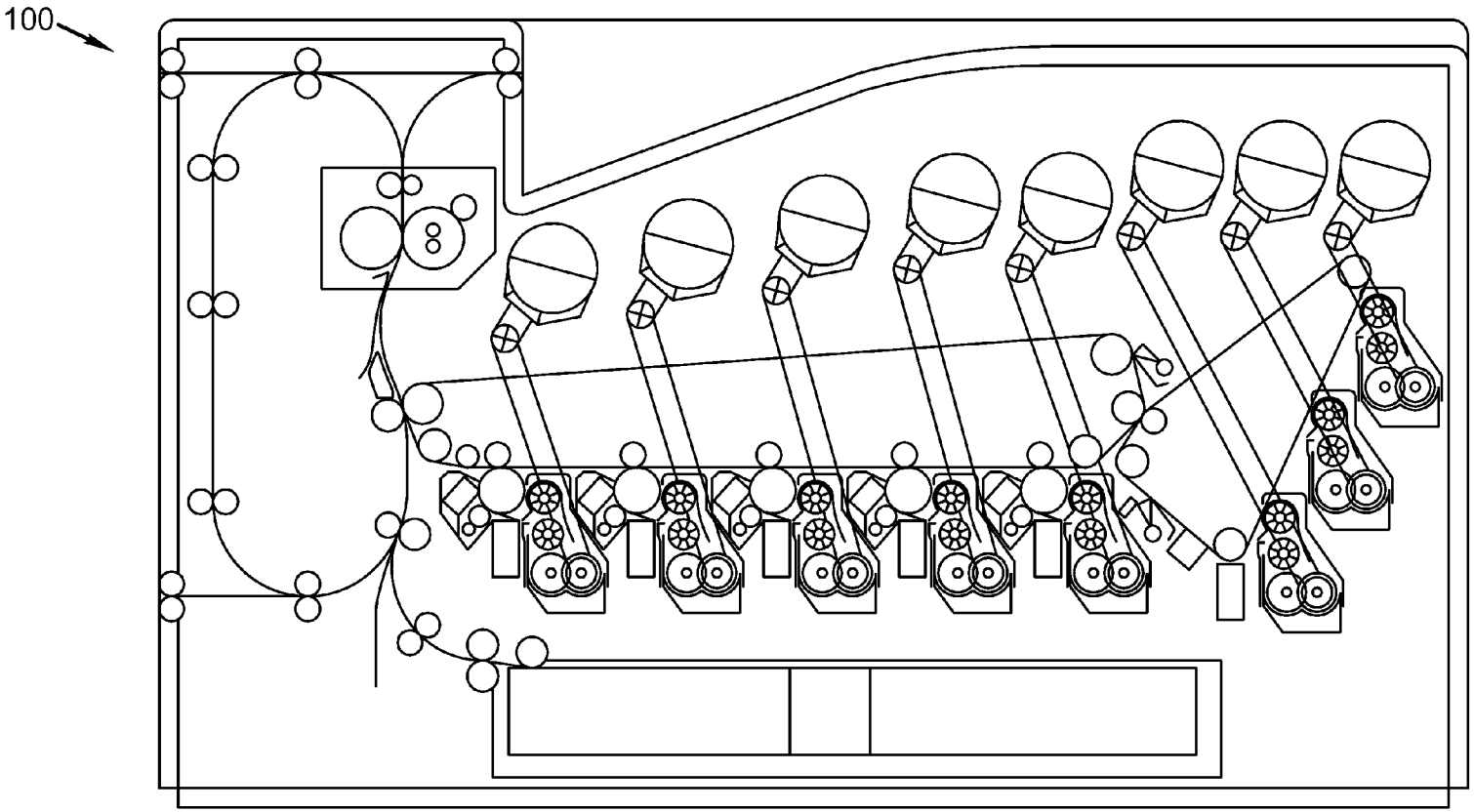
Figure 8G:
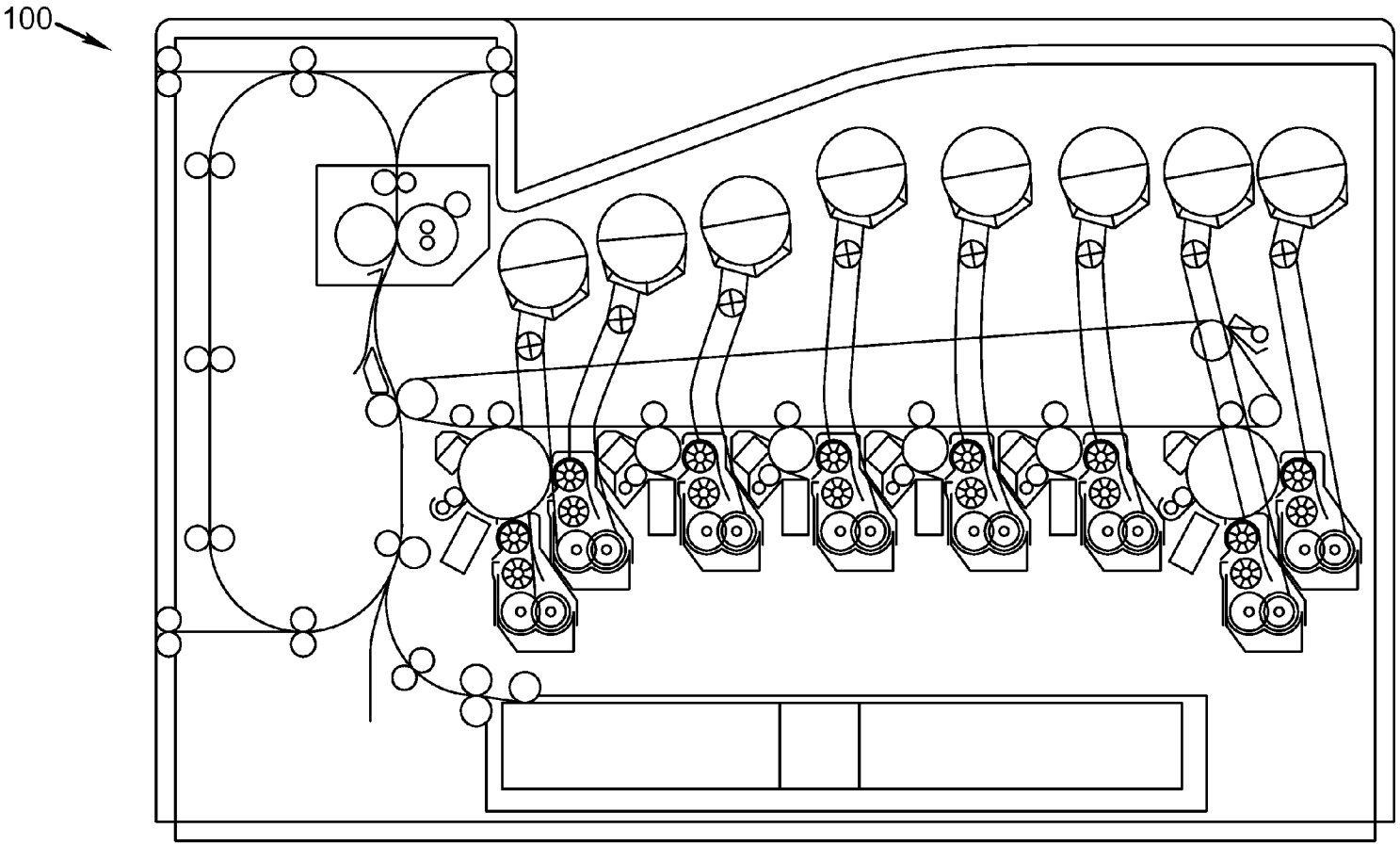
Figure 8H:
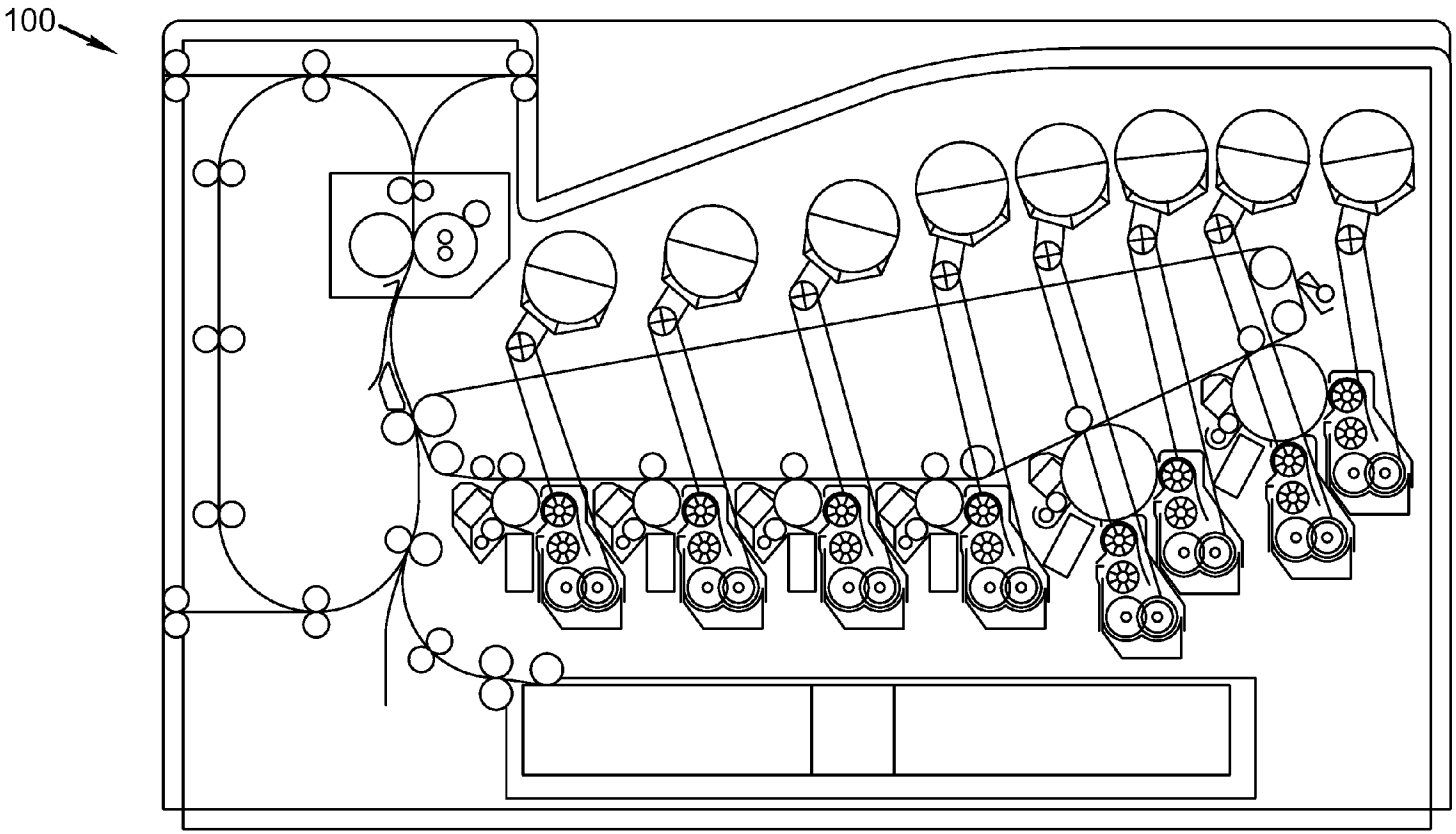
Figure 8I:
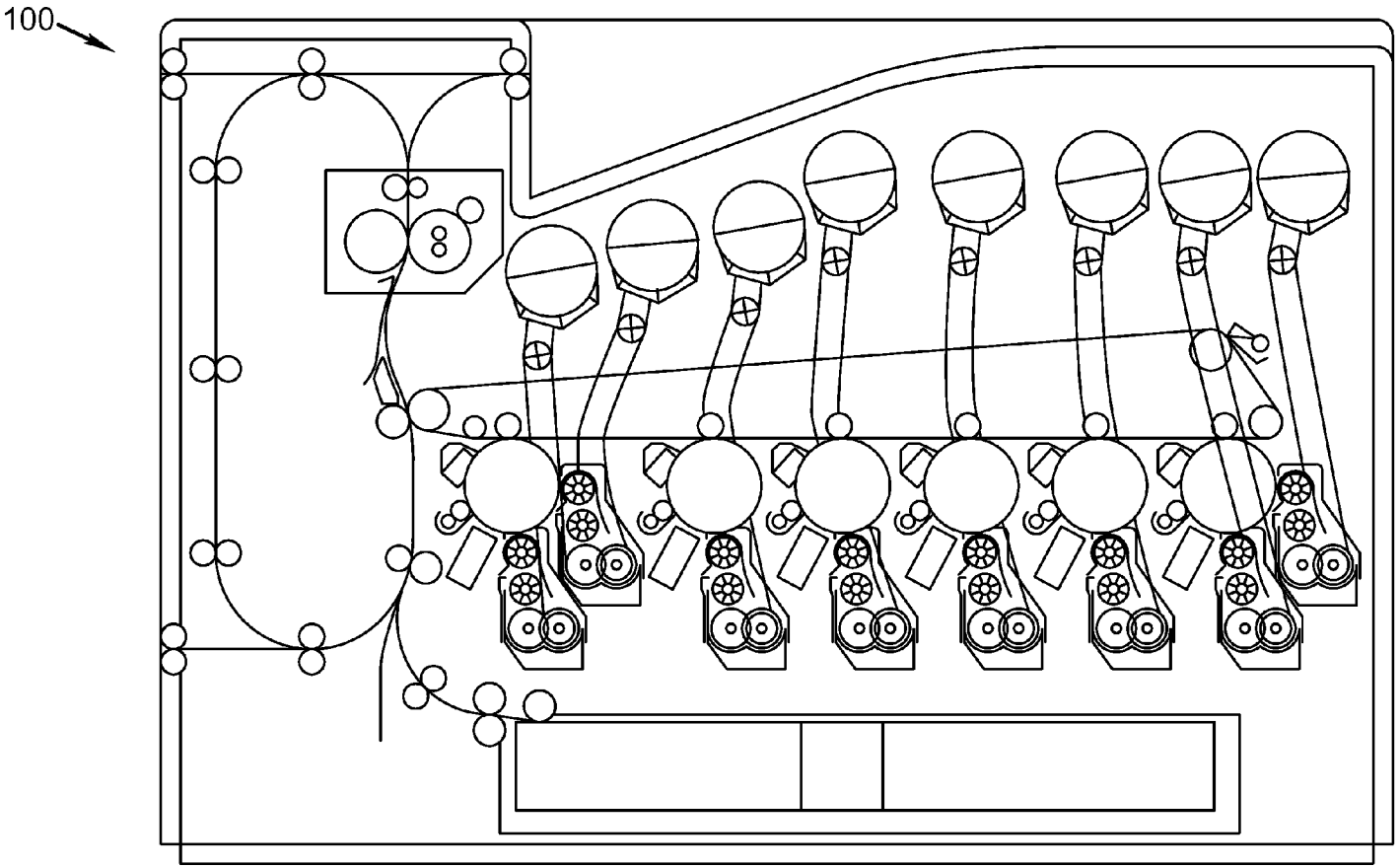
Figure 9:
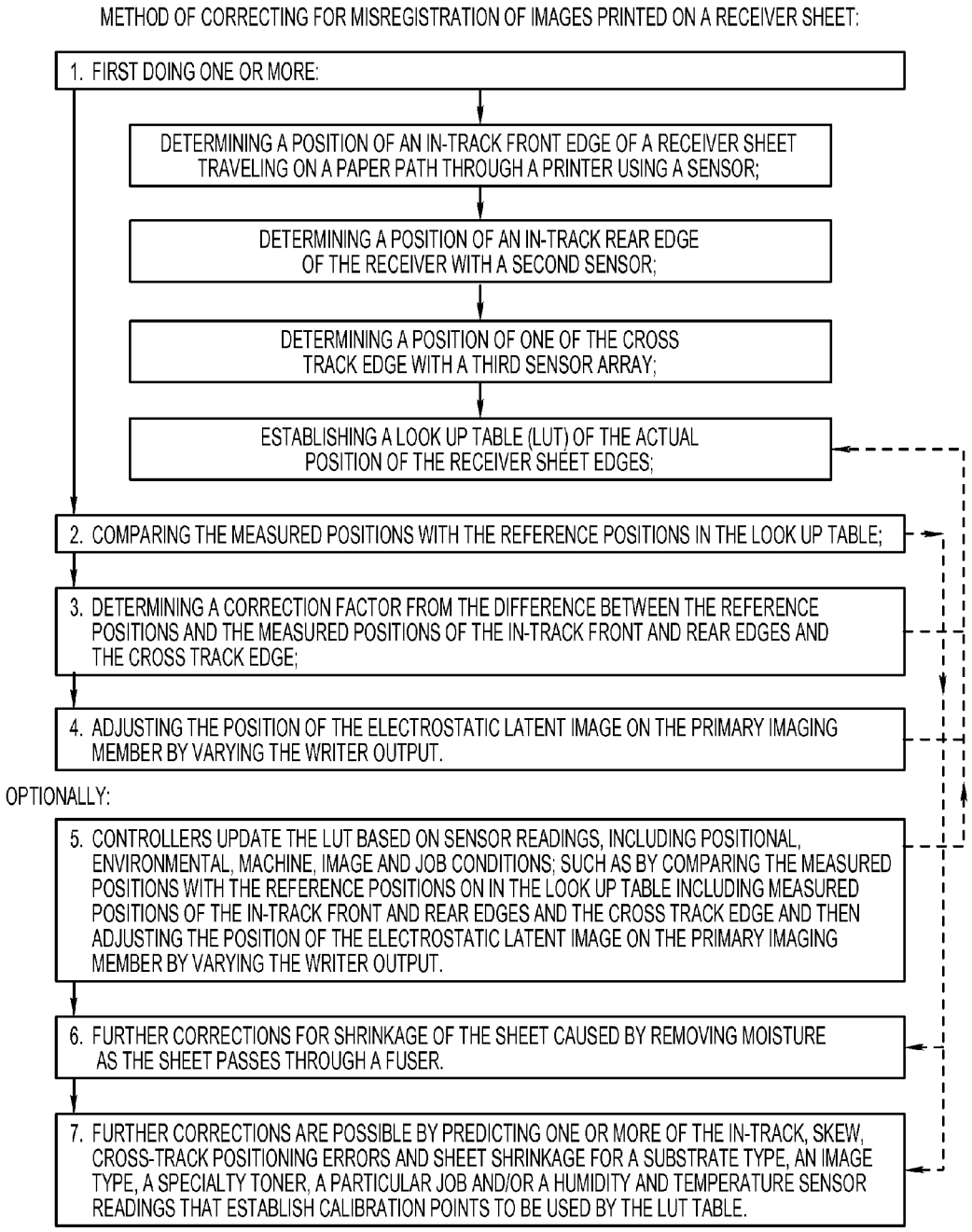
FIG. 9 shows an embodiment of a method of correcting errors according to the present invention.

In-track, skew, and cross-track positioning errors occur as the sheet moves thru the paper path and also result from effects such as the nip roller pairs 190 not being parallel to each other, nip force unevenness front to rear, and roller coefficient of friction variations front to rear or any roller pairs 192. These nip roller attributes are part of the normal manufacturing tolerances that would be expected, however they should remain fairly constant throughout the life of the printer. These errors are, in one embodiment, measured using a pair of sensors with one sensor 194 positioned close to the front of the receiver sheet and one sensor 196 positioned close to the rear of the receiver sheet for in-track position and skew. A third sensor array containing a plurality of individual sensors 198 and positioned along either the front or rear edge of the receiver, as shown in FIG. 7, would enable measuring cross-track position by a method such as in FIG. 9. This sensor array can measure variable cross-track widths.

This information would be recorded in a "look up" table 220 for different sheet or substrate types (see top view sketch of sensors). This information could then be used to predict the sheet to image error and correction could take place using the image formation device. This device such as an LED writer would adjust its placement of the image or images on the photoconductor so that when it is transferred to the intermediate web and then to the receiver sheet position at the second transfer nip is correct. Sheet shrinkage could also be predicted and compensated for using the same sensors and image formation device or devices. The printer could also have a humidity and temperature sensors and these values could be use to establish a calibration point at which the "look up" table was established. Sheet or substrate shrinkage could be affected by the value changes.

In one embodiment the error correction method includes the following steps establishing a look up table of the actual position of the receiver sheet edges; comparing the measured positions with the reference positions in the look up table; determining a correction factor from the difference between the reference positions and the measured positions of the in-track front 232 and rear edges 234 and the cross track edge; and adjusting the position of the electrostatic latent image on the primary imaging member by varying the writer output. This method can use an LED array for the writer.

Figure 5:
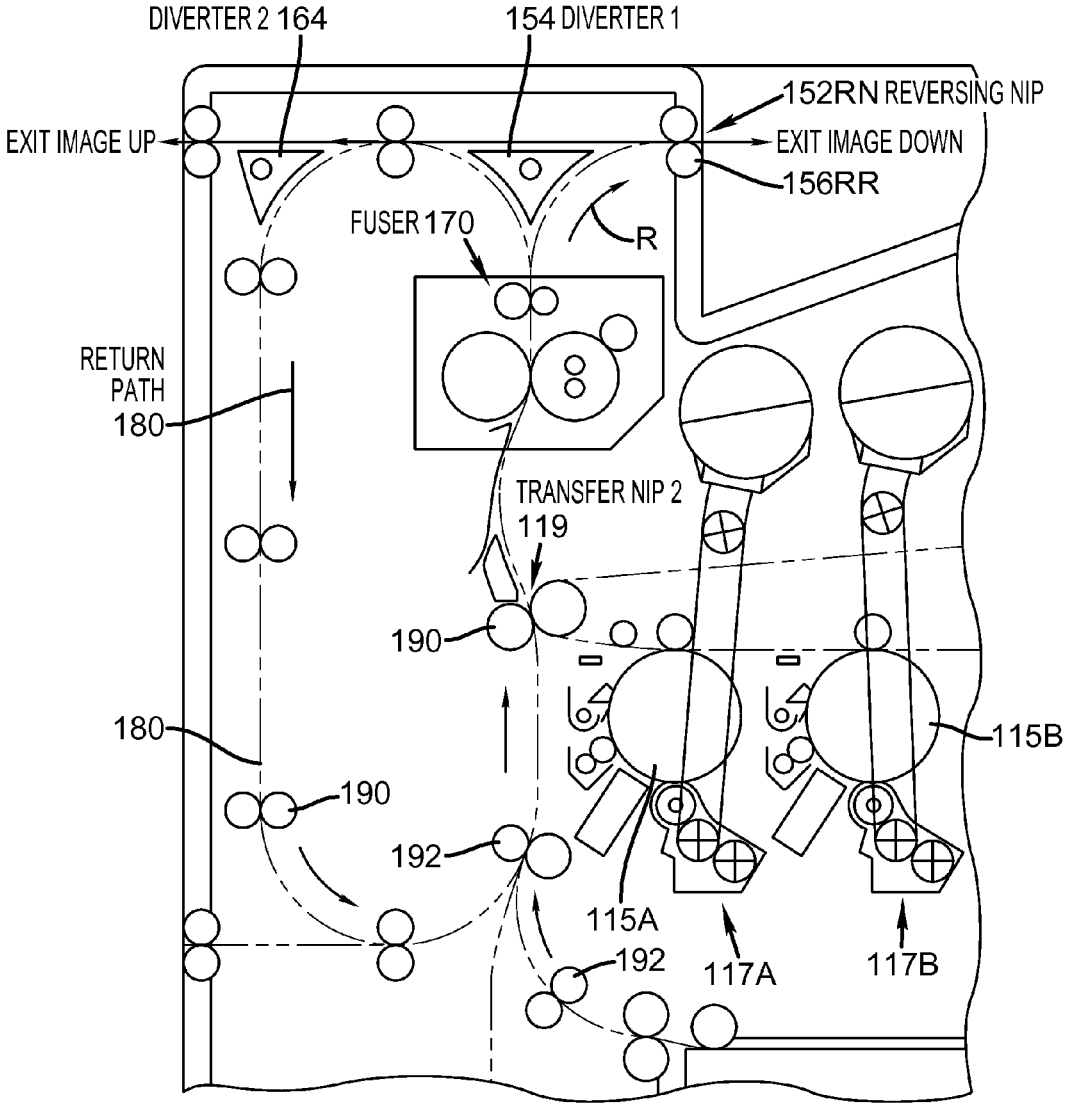
FIG. 5 shows an electrophotographic print apparatus containing two diverters according to the present invention.
Figure 6:
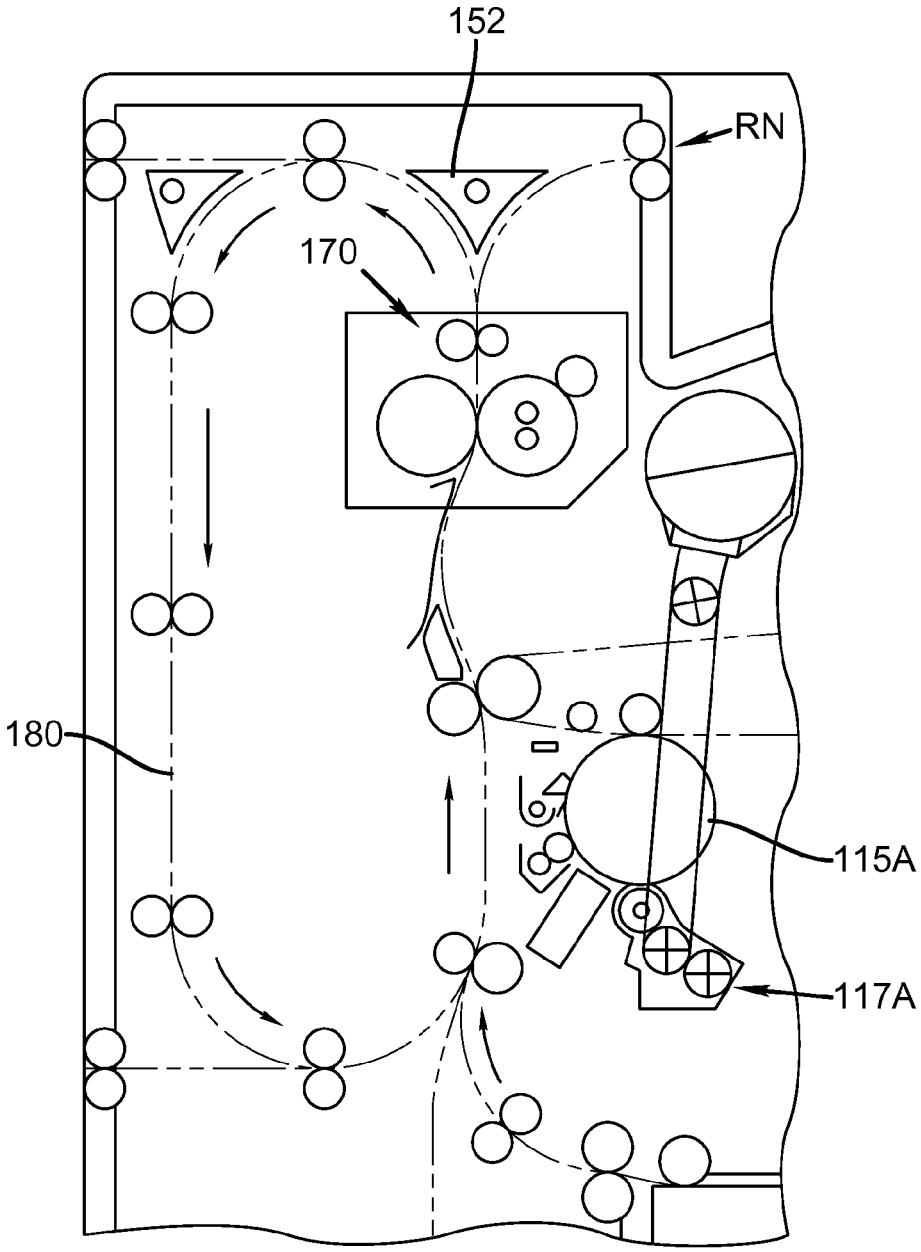
FIG. 6 shows a configuration with a multipass simplex paper path according to the present invention.

The present invention offers yet another advantage over the existing art. In other EP engines, receiver sheets exit the EP engine most often face down because it is more consistent with the receiver path. However, it is advantageous, in some instances such as when generating color proofs, to allow the receiver to exit with the imaged side up. A modification of the present invention allows the operator to select the orientation of the exiting receiver sheet using controller 210. Specifically, as shown in FIG. 5, the addition of a second diverter 164, used in conjunction with the inverter diverter 154 which is part of the inverter 162, enables the receiver to exit the EP engine face up. To exit face up, the inverter diverter 154 is set allow the receiver sheet to enter the inverter 162. A second inverter then is set to prevent the receiver from reentering the paper path 180 in the loop that would result in toned images being transferred to it, and, instead, directs the receiver sheet to the exit in the face up configuration. While the face up exit configuration would be normally used in simplex imaging, it can also be used, if desired, in duplex imaging. In this instance, the toned images are first transferred to the simplex side of the receiver. The inverter diverter is first set to invert the sheet and the exit diverter 164 is set to allow the receiver to reenter the paper path 180 so that images can be transferred to the duplex side. Upon completion of duplex imaging, the sheet is again allowed to reenter the inverter, instead of simply exiting the EP machine, and inverted. The exiting inverter is now set to allow the duplexed print to exit the machine with the simplex side face up.

The invention has been described in detail with particular reference to certain preferred embodiments thereof, but it will be understood that variations and modifications can be effected within the spirit and scope of the invention.

What is claimed is:

1. A method of printing using an electrophotographic print engine including a single development module that can develop a single toner on a primary imaging member of the single development module and a multi-development module that can develop either one of two toners on a primary imaging member of the multi-development module, the method comprising:

determining a combination of toners required to form an image according to a job specification;

determining that the combination of toners includes two toners in the multi-development module, developing and transferring first toner separations onto a receiver including a first one of the two toners in a development station of the multi-development module passing the receiver through the print engine a second time;

developing and transferring a color separation using the other of the two toners in the multi-development module onto the first toner separations; and determining that the identified combination of toners does not include two toners in two development stations in the multi-development module, forming and transferring a first combination of the identified toner separations onto the receiver and diverting the receiver to at least one of an inverter and an exit.

2. The method according to claim 1 further comprising the step of determining when the combination of toners includes a specialty toner and further causing an indicator to specify a development module in which a specialty toner is to be applied.

3. The method according to claim 1 further comprising the step of selecting a development module in which to deposit a determined toner that is not loaded into one of the development modules toner based on job information.

4. The method according to claim 1 wherein one or more development stations of the multi-development module contains a marking that informs the electrophotographic print engine as to the contents of the one or more development stations.

5. An electrophotographic print engine comprising;

a single development module capable of developing one toner on a primary imaging member in the single development module;

at least one multi-development module having two development stations capable of developing one of two toners on a primary imaging member in the multi-development module; and a path that moves a receiver past the print engine and a return path that returns the receiver to the development modules;

a control unit arranged such that the control unit determines a combination of toners required to form an image according to a job specification and that the combination of toners includes two toners in the multi-development module, developing and transferring first toner separations onto the receiver including a first one of the two toners in the multi-development module with the controller further being arranged to cause the receiver to pass through the print engine a second time to allow a color separation to be developed using the other of the two toners in the multi-development module and transferred onto the first toner separations; and wherein the controller is further arranged to determine that the identified combination of toners does not include two toners in the two development stations in the multi-development module, forming and transferring a first combination of the identified toner separations onto the receiver and diverting the receiver to at least one of an inverter and an exit.

6. The print engine according to claim 5, wherein the multi-development module informs the electrophotographic print engine as to the toners in the development station of the multi-development module.

7. The print engine according to claim 5, further comprising a diverter that the controller can cause to either divert a printed receiver through an inverter that allows a returned print to be printed on a different side from a previous print to form a duplex print or to divert a receiver to the return path for the development and transfer of an image using the other of the toners in the multi-development module.

* * * * *